US006848958B2

(12) United States Patent
Garwood

(10) Patent No.: US 6,848,958 B2
(45) **Date of Patent: *Feb. 1, 2005**

(54) MANUALLY PROPELLED PERSONAL FLOTATION DEVICE

(75) Inventor: Clint Garwood, Chicago, IL (US)

(73) Assignee: Hydro Blade, Inc., Bloomingdale, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/708,627

(22) Filed: Mar. 16, 2004

(65) Prior Publication Data

US 2004/0266288 A1 Dec. 30, 2004

Related U.S. Application Data

(63) Continuation of application No. 10/604,139, filed on Jun. 27, 2003, now Pat. No. 6,736,688.

(51) Int. Cl.[7] ..... A63B 31/00
(52) U.S. Cl. ..... 441/55; 441/61
(58) Field of Search ..... 441/55, 59, 60, 441/61, 64, 65; 440/18, 23, 24; 114/315

(56) References Cited

U.S. PATENT DOCUMENTS

| | | | | | |
|---|---|---|---|---|---|
| 693,615 | A | | 2/1902 | Minkus | 440/24 |
| 998,146 | A | | 7/1911 | Alfier et al. | 441/60 |
| 1,329,660 | A | * | 2/1920 | Kaye | 441/59 |
| 1,335,687 | A | | 3/1920 | Johnston | 441/55 |
| 1,474,952 | A | | 11/1923 | Allen et al. | 440/24 |
| 1,587,605 | A | * | 6/1926 | Scroggins | 441/59 |
| 1,792,605 | A | | 2/1931 | Reeve | 441/55 |
| 2,343,965 | A | | 3/1944 | Fisch | 441/61 |
| 3,122,759 | A | * | 3/1964 | Gongwer | 441/60 |
| 3,349,746 | A | | 10/1967 | Sydoriak | 440/24 |
| 3,505,970 | A | * | 4/1970 | Sydoriak | 440/24 |
| 3,833,956 | A | | 9/1974 | Meehan | 441/76 |
| 3,835,494 | A | | 9/1974 | Dougherty | 441/77 |
| 4,158,245 | A | | 6/1979 | Cunningham | 440/18 |
| 4,664,639 | A | | 5/1987 | Schneider | 441/61 |
| 4,738,643 | A | | 4/1988 | Noggle | 440/103 |
| 4,846,743 | A | | 7/1989 | Ping-chuan | 441/77 |
| 5,009,441 | A | | 4/1991 | Toft | 280/14.23 |
| 5,087,217 | A | | 2/1992 | Tuan et al. | 441/61 |
| 5,458,514 | A | | 10/1995 | Hsia | 441/77 |
| 5,645,460 | A | | 7/1997 | Johnson | 441/61 |
| 5,795,268 | A | | 8/1998 | Husted | 482/51 |
| 6,077,139 | A | | 6/2000 | Celik | 441/64 |
| 6,083,066 | A | | 7/2000 | Wright | 440/102 |
| 6,227,923 | B1 | | 5/2001 | Johnson | 441/61 |

* cited by examiner

*Primary Examiner*—Lars A. Olson
(74) *Attorney, Agent, or Firm*—Seyfarth Shaw LLP

(57) ABSTRACT

A personal floatation apparatus comprising a central body portion, adapted to float in a body of water, with a propulsion structure pivotally coupled to the body having an elongated rod member with upper and lower portions and a fin member pivotally coupled intermediate the respective portions. The upper and lower portions are inversely pivotal relative to each other, wherein when the upper portion is disposed forwardly and the lower portion is disposed rearwardly, relative to the body, and vice-versa. The fin member is adapted to extend substantially perpendicular from the body when the lower portion is moved from the forward to rearward positions, thereby encouraging forward movement of the floatation apparatus caused by water resistance acting upon the fin member. The fin member is adapted to lay substantially parallel to the body when the lower portion is moved from the rearward to the forward position, thereby encouraging continued forward movement in a gliding manner.

19 Claims, 4 Drawing Sheets

FIG. 2
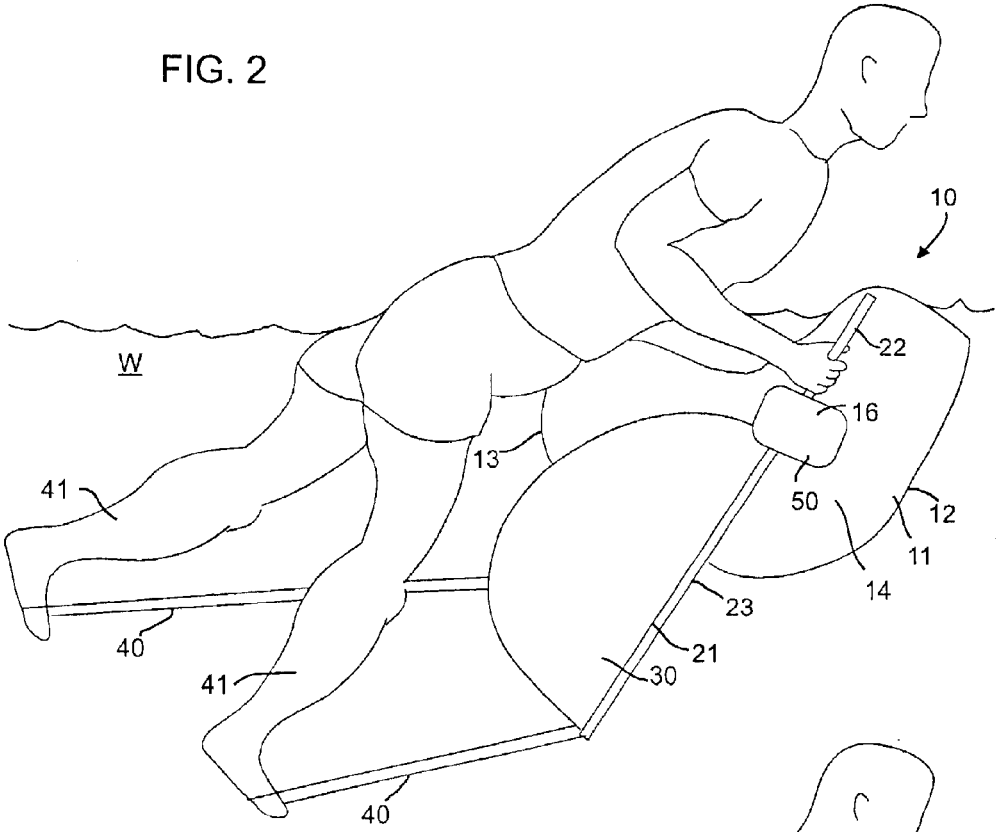
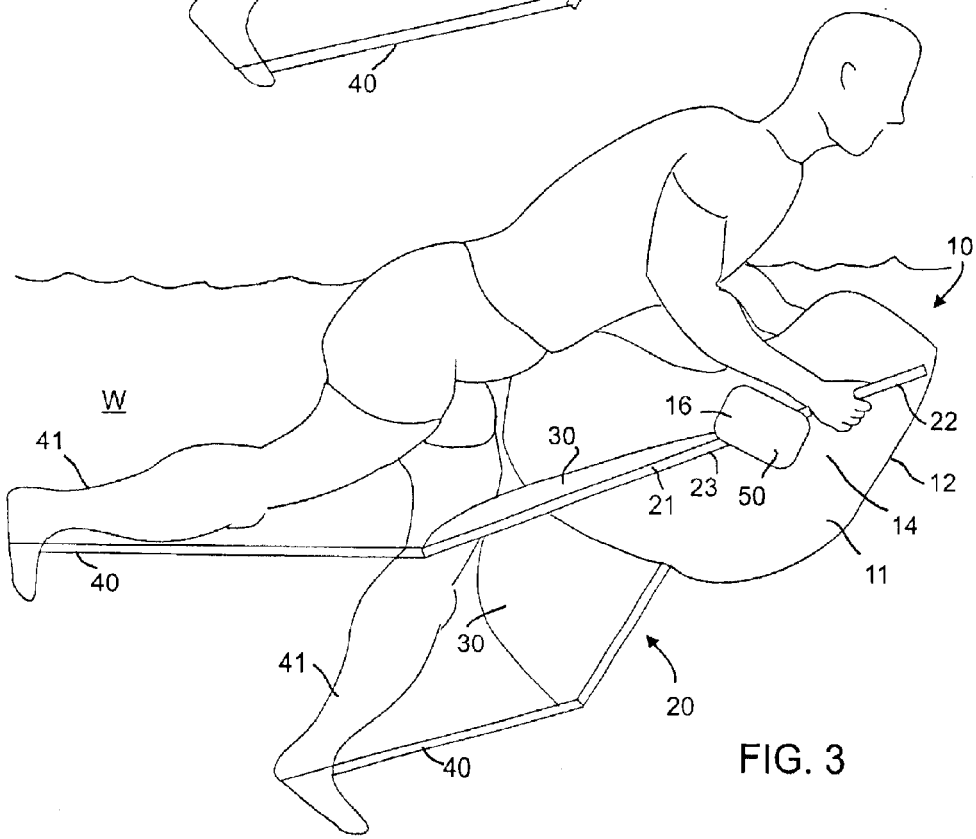
FIG. 3

MANUALLY PROPELLED PERSONAL FLOTATION DEVICE

CROSS REFERENCE TO RELATED APPLICATIONS

This is a continuation of U.S. application Ser. No. 10/604,139, filed on Jun. 27, 2003, now U.S. Pat. No. 6,736,688, and titled "Manually Propelled Personal Flotation Device."

BACKGROUND OF INVENTION

The present application relates generally to personal floatation devices and, more particularly, to personal floatation devices that are manually propelled in a body of water.

It is well known that personal floatation devices, such as air-encapsulating inner tubes and the like, can be propelled by a user with simple hand and/or foot movement. It is also well known that such movement can be maximized and enhanced with the utilization of fin-like structures, typically coupled to a user's foot, to maximize water resistance to cause the floatation device to travel in the desired direction. However, a limitation of such a design is that hand and leg movement are not synchronized and thus can be counter-productive. Further, when returning the fin-like structure to the origination point to begin another cycle, the fin-like structure generally increases water resistance in the return stroke, consequently degrading and hindering travel in the desired direction.

It is also well known that simultaneous and synchronous hand and foot movement can be achieved via a ski-like machine on land, wherein an interconnecting structure, such as an elongated rod, is used to coordinate hand and leg movement. However, such a structure is not readily adaptable for water usage, let alone buoyancy. As such, there exists a need in personal floatation devices to incorporate the benefits of simultaneous and synchronous movement of the hands and legs.

SUMMARY OF INVENTION

The present application discloses a manually propelled personal floatation apparatus. The apparatus comprises a central body portion capable of being buoyant in a body of water and a depending propulsion structure that is pivotally coupled to the body portion.

The propulsion structure includes a fin member pivotally coupled to an elongated rod and is adapted to extend substantially perpendicular from the body portion, thereby acting as a sail, to propel the floatation apparatus forwardly and to lay substantially parallel to the body portion to encourage continued gliding of the floatation apparatus. The elongated rod is pivotal between forward and rearward positions relative to the body portion. As such, when the rod is pivoted from the forward to the rearward position, the fin member extends perpendicular from the body portion, consequently affecting forward movement of the floatation apparatus caused by water resistance acting upon the fin member. When the rod is pivoted from the rearward position to the forward position, the fin member lays parallel to the body portion where water resistance with the fin member is minimized, thus encouraging continued forward movement of the floatation apparatus in a gliding manner.

A foot-holding structure, adapted to secure a user's foot or leg to the elongated rod, may be coupled adjacent to the lowermost terminus of the elongated rod. In such an embodiment, the user's foot or leg can assist the manual movement of the elongated rod from forward and rearward positions relative to the central body portion, and vice-versa, thereby assisting in forward propulsion.

BRIEF DESCRIPTION OF DRAWINGS

For the purpose of facilitating an understanding of the subject matter sought to be protected, there are illustrated in the accompanying drawings embodiments thereof, from an inspection of which, when considered in connection with the following description, the subject matter sought to be protected, its construction and operation, and many of its advantages, should be readily understood and appreciated.

FIG. 2 is a reduced side view of the floatation apparatus of FIG. 1 depicted in use by a user with the foreground fin member disposed in the substantially parallel position;

FIG. 3 is a view similar to FIG. 2 with the foreground fin member disposed in the substantially perpendicular position;

DETAILED DESCRIPTION

Figure 1:
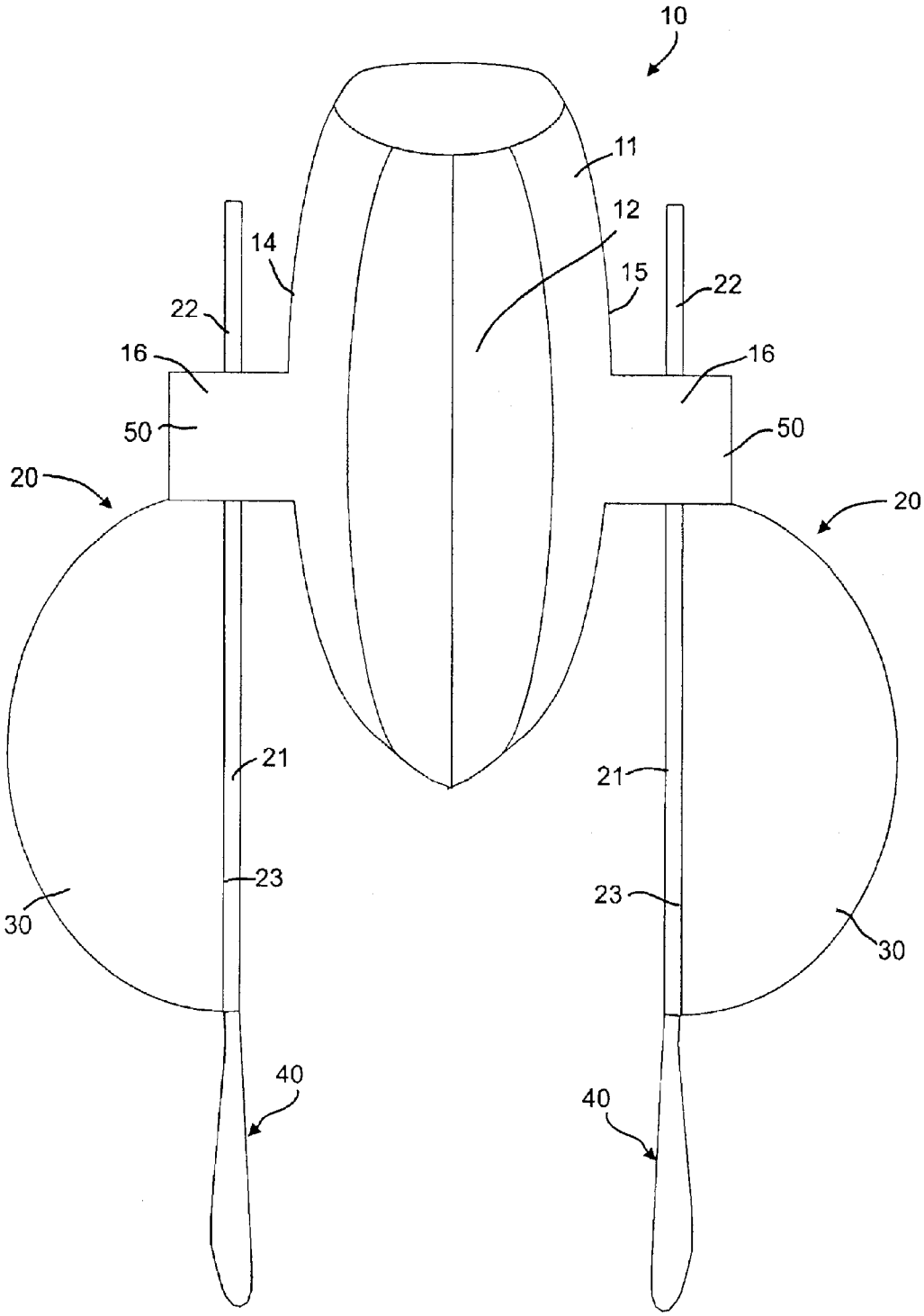
FIG. 1 is a front elevation view of a floatation apparatus in accordance with the present application.
Figure 4:
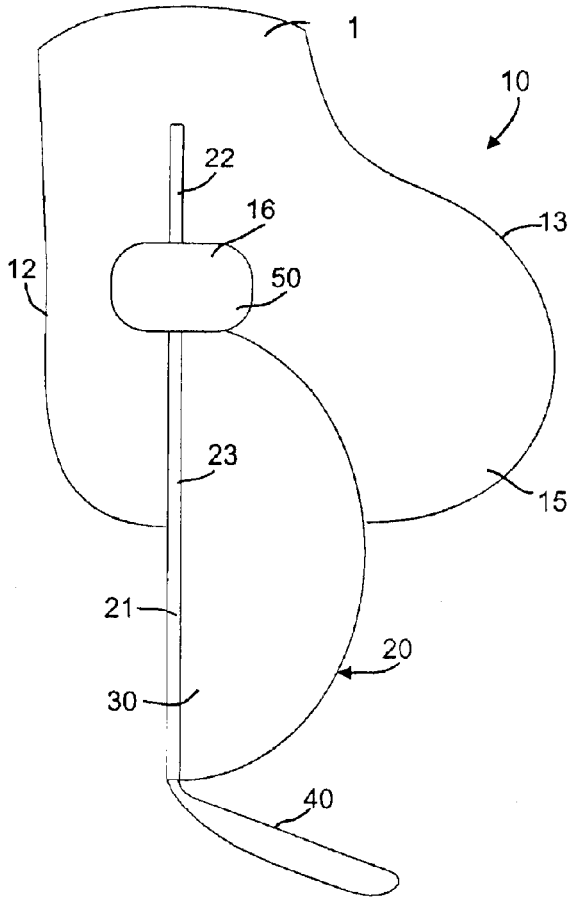
FIG. 4 is an enlarged, side elevation view of the floatation apparatus of FIG. 1 with the fin member disposed in the substantially parallel position.
Figure 5:
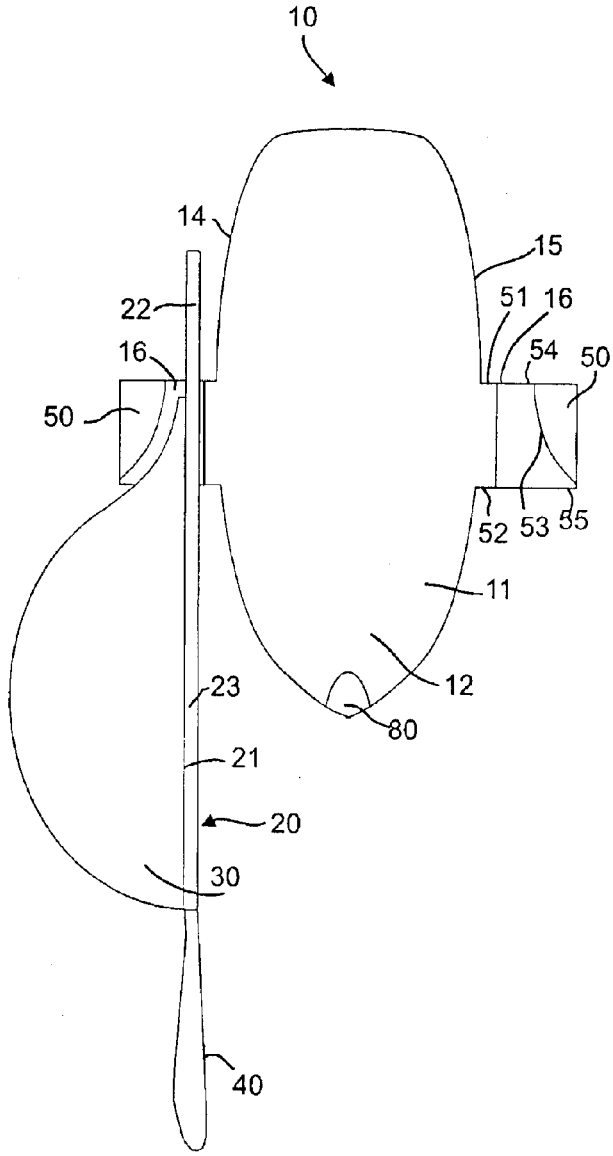
FIG. 5 is a cross-sectional front view taken along line 5—5 in FIG. 1 with a propulsion structure removed for clarity purposes.
Figure 6:
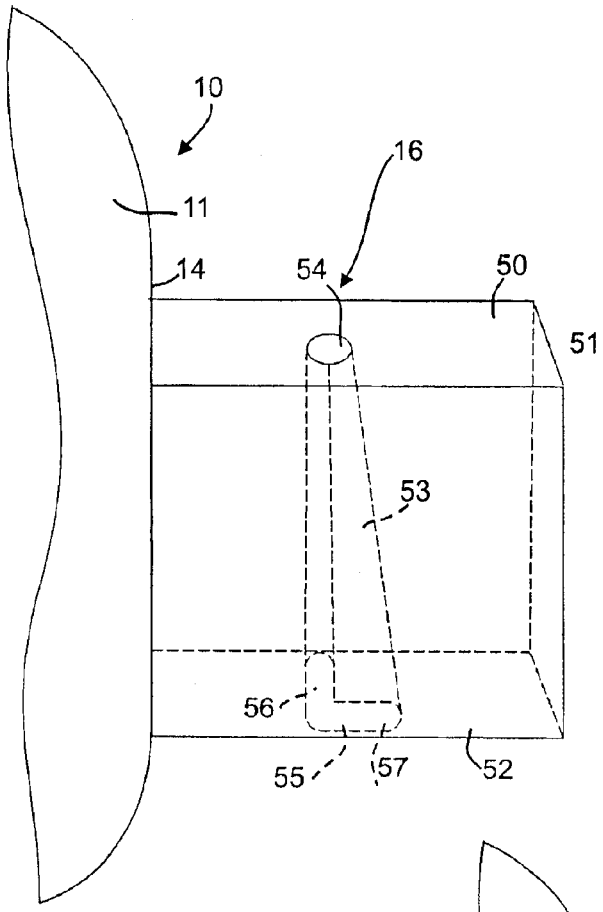
FIG. 6 is an enlarged, rear view of the pivoting structure of FIG. 1 with the vertical bore and bottom surface shown with hidden lines.
Figure 7:
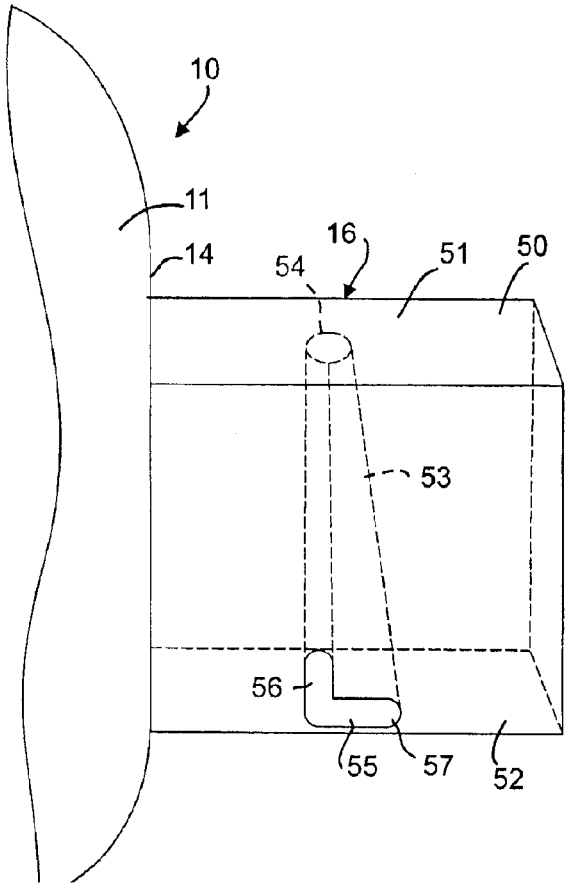
FIG. 7 is a view similar to FIG. 6 but with the vertical bore and the top surface shown with hidden lines.

Referring to the figures, the present application discloses a manually propelled personal floatation apparatus 10. The apparatus comprises a central body portion 11 capable of being buoyant in a body of water W that has a front 12, a back 13 and two transversely opposing sides 14, 15.

A propulsion structure 20 is pivotally coupled to at least one side 14 of the central body portion 11 with a pivoting structure 16 and depends downwardly therefrom into the water W. In an embodiment, a depending propulsion structure 20 may be pivotally coupled to each respective side 14, 15. In such an embodiment, the respective propulsion structures 20 will be substantially similar in design and configuration but will be inverse relative to each other.

The back 13 of the central body portion 11 may have an ergonomic shape to support a user's torso and position during use. The back 13 may include a flattened portion adapted to abut the user's torso. The front 12 of the central body portion 11 may be substantially similar to a boat hull configuration, thereby angling to an intersection point.

The propulsion structure 20 includes an oar-like member having an elongated rod 21 with respective upper and lower portions 22, 23 and is pivotally coupled to the central body portion 11 in such a manner so as to facilitate movement of the upper and lower portions 22, 23 between forward and rearward positions relative to the central body portion 11 and inversely relative to each other. In other words, when the upper portion 22 is disposed in the forward position, the lower portion 23 is disposed in the rearward position, and vice-versa. The elongated rod 21 is disposed relative to the central body portion 11 such that the upper portion 22 extends substantially upwardly from the central body portion 11 and the lower portion 23 extends substantially downwardly from the central body portion 11.

A fin member 30 is pivotally coupled to the elongated rod 21 intermediate the upper and lower portions 22, 23 and is adapted to extend substantially perpendicular from the central body portion 11, thereby replicating a sail, when the lower portion 23 is moved from the forward position to the rearward position and lay substantially parallel to the central body portion 11 when the lower portion 23 is moved from the rearward position to the forward position.

Forward movement of the floatation apparatus 10 is caused by manually moving the upper portion 22 from the rearward position to the forward position, consequently moving the lower portion 23 from the forward position to the rearward position and causing the fin member 30 to extend substantially perpendicular from the central body portion 11 to replicate a sail (as depicted in FIG. 3), thereby increasing water resistance acting upon the fin member 30 to cause the floatation apparatus 10 to travel along a substantially forwardly directed vector. When the lower portion 23 is returned to the forward position by manually moving the upper portion 22 from the forward position to the rearward position, consequently moving the lower portion 23 from the rearward position to the forward position and causing the fin member 30 to lay substantially parallel to the central body portion (as depicted in FIG. 2), water resistance between the fin member 30 and the surrounding water is minimized, thus encouraging aging forward movement of the floatation apparatus 10 in a gliding manner.

Controlled braking or steering of the floating apparatus 10 may be accomplished by selectively causing the fin member 30 to extend substantially perpendicular from the central body portion 11 and maintaining such a position. In such an extended position, again replicating a sail, water resistance acts upon the fin member 30 causing the floating apparatus 10 to slow down and/or turn in the desired direction.

A foot-holding structure 40, adapted to secure a user's foot or leg 41 to the lower portion 23 of the elongated rod 21, may be coupled adjacent to the terminus of the lower portion 23. In such an embodiment, the user's foot or leg 41 can assist the manual movement of the lower portion 23 from the forward position to the rearward position and vice-versa. In an embodiment, the foot-holding structure 40 may include a strap having both respective strap termini coupled to the terminus of the lower portion 23, thereby defining a loop. It will be appreciated that while a looped strap is depicted in the figures, other foot-holding structures 40 can be utilized while not departing from the true scope and spirit of the present application.

The pivoting structure 16 may include an outwardly extending wing structure 50 disposed adjacent to the waterline on a side 14 of the central body portion 11. The wing structure 50 has respective top and bottom surfaces 51, 52 connected by a vertically aligned bore 53 terminating with apertures 54, 55 disposed on each respective surface 51, 52. The aperture 54 on the top surface 51 may be substantially circular and the aperture 55 on the bottom surface 52 may be substantially L-shaped, with a first leg 56 extending parallel to the central body portion 11 and a second leg 57 extending perpendicular from the central body portion 11. The first and second legs 56, 57 intersect each other at an intersection point. In such an embodiment, the bore 53 interconnecting the respective apertures 54, 55 is proportionally shaped and tapered to provide a smooth transition therebetween. The elongated rod 21 is disposed through the bore 53 wherein the upper portion 22 is disposed above the top surface 51 and the fin member 30 and the lower portion 23 is disposed substantially below the bottom surface 52. In this embodiment, the fin member 30 is encouraged to extend perpendicular from the central body portion 11 (as depicted in FIG. 3), when the lower portion 23 is moved from the forward position to the rearward position, by the second-leg 57 of the L-shaped aperture 55 and tapered bore 53. Conversely, the fin member 30 is encouraged to lay parallel to the central body portion 11 (as depicted in FIG. 2), when the lower portion 23 is moved from the rearward position to the forward position, by the first leg 56 of the L-shaped aperture 55 and tapered bore 53.

A keel 60 may be disposed on the bottommost portion of central body portion 11 to assist the user in stabilizing the floatation apparatus 10 during use. This can be accomplished by manipulating the center of gravity of the flotation apparatus 10.

It will be appreciated that while only one side of the central body portion 11 has been described having a propulsion structure and pivoting structure, the transversely opposing side of the central body portion 11 may have a propulsion structure and pivoting structure with substantially the same configuration as disclosed above.

The matter set forth in the foregoing description and accompanying drawings is offered by way of illustration only and not as a limitation. While particular embodiments have been shown and described, it will be apparent to those skilled in the art that changes and modifications may be made without departing from the broader aspects of applicants" contribution. The actual scope of the protection sought is intended to be defined in the following claims when viewed in their proper perspective based on the prior art.

What is claimed is:

1. A watercraft apparatus comprising:

a body having a front, a back and two transversely opposed sides; and a propulsion structure coupled to the body with a pivoting structure and having an elongated rod member with an upper portion and a lower portion, each portion being moveable between forward and rearward positions relative to the body, and a fin member pivotally coupled to the rod member intermediate the upper and lower portions and adapted to extend substantially perpendicular relative to the body when the lower portion is moved from the forward position to the rearward position and lay substantially parallel relative to the body when the lower portion is moved from the rearward position to the forward position.

2. The apparatus as claimed in claim 1 further comprising a foot attachment structure coupled adjacent to a terminus of the lower portion and adapted to couple a user's foot to the propulsion structure.

3. The apparatus as claimed in claim 2 wherein the foot attachment structure includes a strap coupled to the lower portion and defining a substantial loop of the strap.

4. The apparatus as claimed in claim 1 wherein the upper portion is inversely moveable between the forward and rearward positions relative to the forward and rearward positions of the lower portion.

5. The apparatus as claimed in claim 1 wherein the pivoting structure includes an outwardly extending wing member coupled to the body and having top and bottom sides and a bore extending vertically therethrough and terminating with respective apertures on the top side and on the bottom side.

6. The apparatus as claimed in claim 5 wherein the aperture on the bottom side has a substantial L-shape with a first leg disposed substantially parallel to the body and a second leg disposed substantially perpendicular to the body, the first and second legs intersect each other at an intersection.

7. The apparatus as claimed in claim 6 wherein the aperture disposed on the top side has a substantially circular shape and is substantially axially aligned with the intersection of the first and second legs.

8. The apparatus as claimed in claim 7 wherein the rod member is disposed through the bore wherein the upper portion is disposed above the wing member and the fin member is disposed below the wing member.

9. The apparatus as claimed in claim 7 wherein the bore is proportionally tapered to connect the L-shaped aperture to the circular shaped aperture.

10. A propulsion structure for a water craft comprising:

an elongated rod member coupled to the water craft and having an upper portion and a lower portion, each portion being moveable between forward and rearward positions relative to the water craft, and a fin member pivotally coupled to the rod member intermediate the upper and lower portions and adapted to extend substantially perpendicular relative to the water craft when the lower portion is moved from the forward position to the rearward position and lay substantially parallel relative to the water craft when the lower portion is moved from the rearward position to the forward position.

11. The propulsion structure as claimed in claim 10 further comprising a foot attachment structure coupled adjacent to a terminus of the lower portion.

12. The propulsion structure as claimed in claim 11 wherein the foot attachment structure includes a strap coupled to the lower portion and defining a substantial loop of the strap.

13. The propulsion structure as claimed in claim 10 wherein the upper portion is inversely moveable between the forward and rearward positions relative to the forward and rearward positions of the lower portion.

14. The propulsion structure as claimed in claim 10 wherein the elongated rod member coupled to the water craft with a pivoting structure.

15. The propulsion structure as claimed in claim 14 wherein the pivoting structure includes a wing member having top and bottom sides and a bore extending vertically therethrough and terminating with respective apertures on the top side and on the bottom side.

16. The propulsion structure as claimed in claim 15 wherein the aperture on the bottom side has a substantial L-shape with a first leg disposed substantially parallel to the water craft and a second leg disposed substantially perpendicular to the water craft, the first and second legs intersect each other at an intersection.

17. The propulsion structure as claimed in claim 16 wherein the aperture disposed on the top side has a substantially circular shape and is substantially axially aligned with the intersection of the first and second legs.

18. The propulsion structure as claimed in claim 17 wherein the rod member is disposed through the bore wherein the upper portion is disposed above the wing member and the fin member is disposed below the wing member.

19. A method of propelling a water craft comprising:

coupling a propulsion structure having an elongated rod with a pivotally coupled fin member to the water craft wherein the rod is moveable between forward and rearward positions relative to the water craft; and moving the rod from the forward position to the rearward position, thereby causing water to resist movement of the fin member and causing propulsion of the water craft.

* * * * *